US005606893A

United States Patent [19]

Shifflett

[11] Patent Number: 5,606,893

[45] Date of Patent: Mar. 4, 1997

[54] ROLLING DETENT MECHANISM

[75] Inventor: Dennis Shifflett, Macomb, Mich.

[73] Assignee: TRW Inc., Cleveland, Ohio

[21] Appl. No.: 440,827

[22] Filed: May 15, 1995

[51] Int. Cl.[6] ..... G05G 5/03

[52] U.S. Cl. ..... 74/527; 74/416

[58] Field of Search ..... 74/553, 527, 10.41, 74/416; 126/399, 39 N; 475/220, 331, 336, 344, 347

[56] References Cited

U.S. PATENT DOCUMENTS

| | | | |
|---|---|---|---|
| 2,261,555 | 11/1941 | Luehrs | 475/336 |
| 2,777,336 | 1/1957 | Schonstedt | 74/527 |
| 2,899,841 | 8/1959 | Melloy | 74/553 |
| 3,059,498 | 10/1962 | Boyd | 74/527 |
| 3,130,826 | 4/1964 | Davis et al. | 74/10.41 |
| 3,226,999 | 1/1966 | Allison | 74/527 |
| 3,309,940 | 3/1967 | Rosl | 74/527 |
| 3,415,141 | 12/1968 | Ungerman | 74/527 |
| 3,599,497 | 8/1971 | Fukumitsu | 74/10.41 |
| 3,768,333 | 10/1973 | Bidwell | 74/527 |
| 3,786,693 | 1/1974 | Keipert | 74/527 |
| 4,038,508 | 7/1977 | Mapelsden | 200/329 |
| 4,656,926 | 4/1987 | Bauer et al. | 74/553 |
| 5,127,286 | 7/1992 | Wittig | 74/553 |

FOREIGN PATENT DOCUMENTS

| | | | |
|---|---|---|---|
| 540896 | 7/1922 | France | 475/336 |
| 17644 | 8/1906 | United Kingdom | 475/220 |
| 17880 | 8/1907 | United Kingdom | 475/220 |
| 845489 | 8/1960 | United Kingdom . | |

*Primary Examiner*—Vinh T. Luong
*Assistant Examiner*—Mary Ann Battista
*Attorney, Agent, or Firm*—Fay, Sharpe, Beall, Fagan, Minnich & McKee

[57] ABSTRACT

A rotary detent mechanism comprises a first wheel having a plurality of radially extending lobes circumferentially spaced about its axis of rotation. Second and third wheels each having outwardly extending ribs spaced for driving engagement with the lobes of the first wheel are positioned on opposite sides thereof. The ribs of the second and third wheels are related to the lobes of the first wheel such that driving rotation between the first wheel and the second and third wheels requires relative movement of the wheels toward and away from one another in a direction perpendicular to the axis of rotation of the first wheel. A drive member is provided for selectively rotating one of the wheels and a spring assembly is provided for biasing the wheels toward one another in a direction perpendicular to the first axis.

14 Claims, 3 Drawing Sheets

Fig. 3
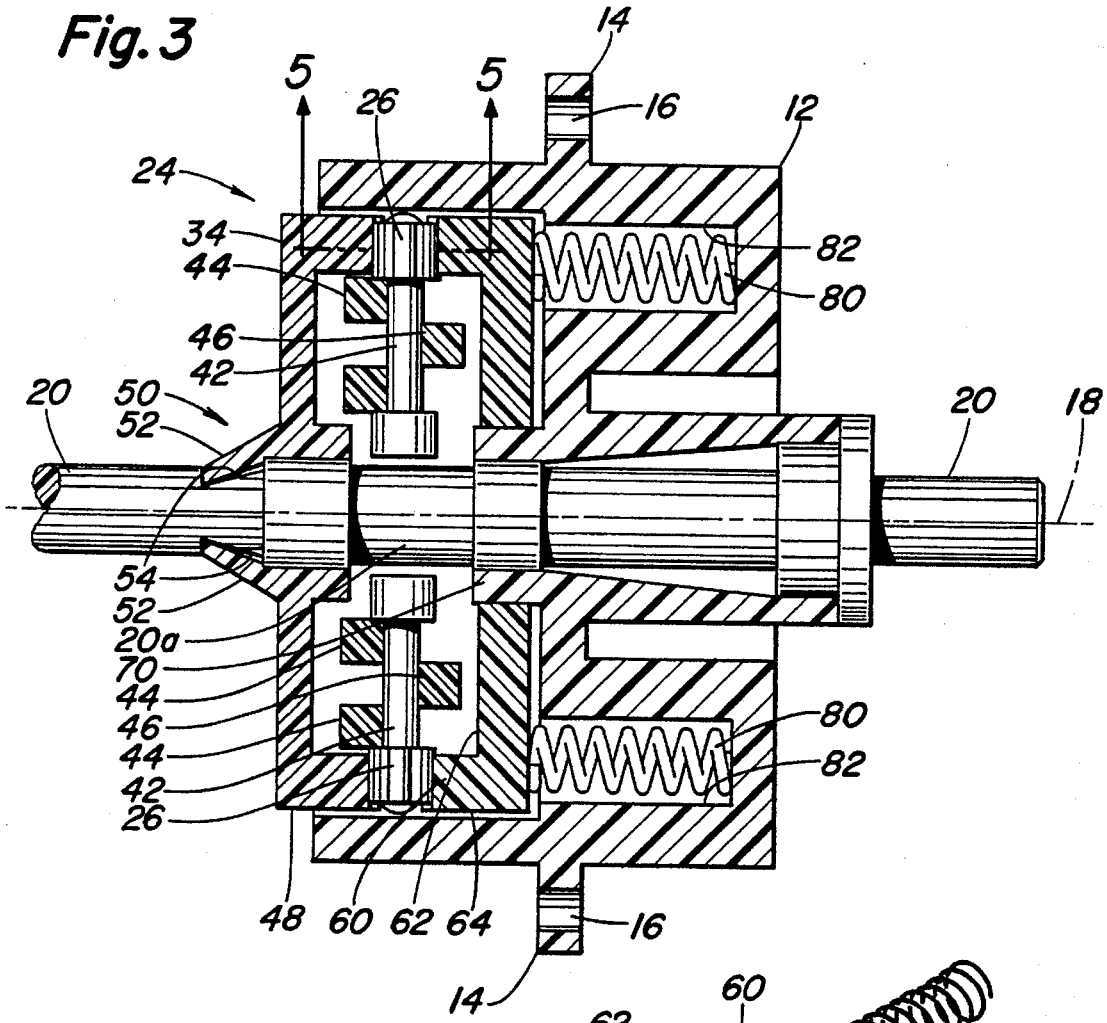
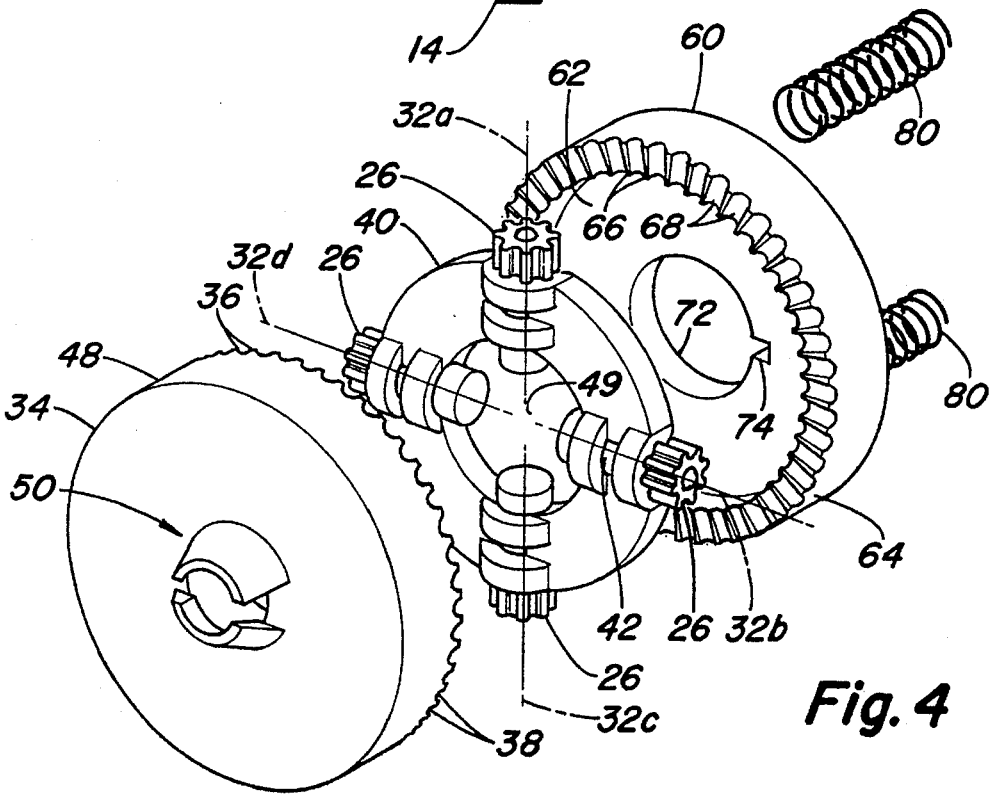
Fig. 4

Fig. 5
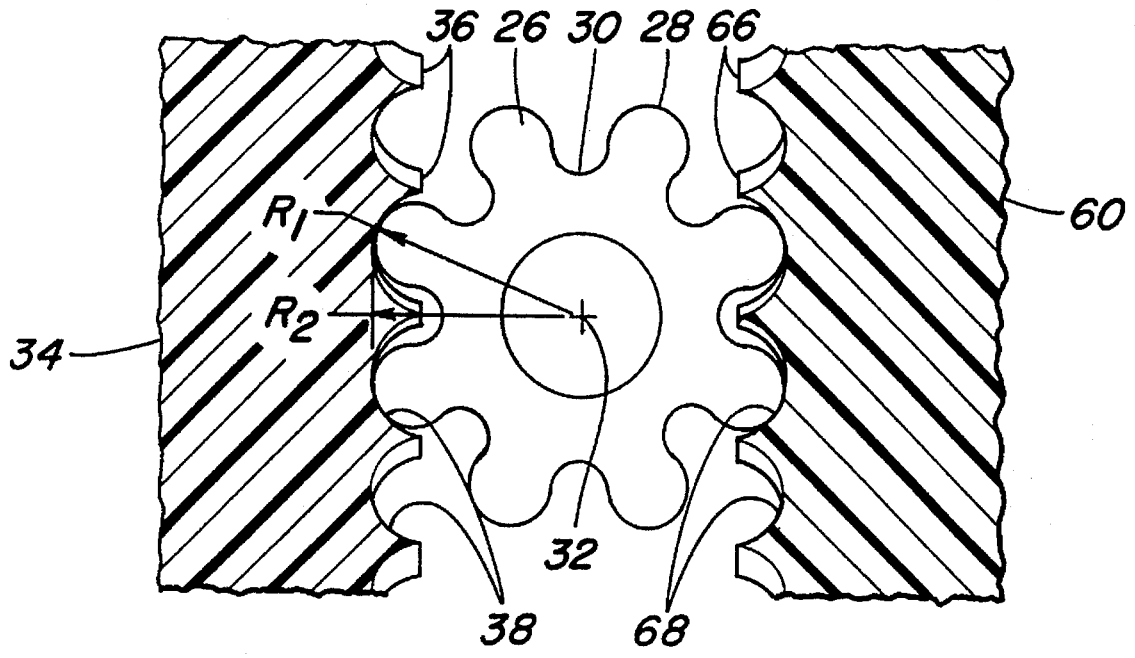
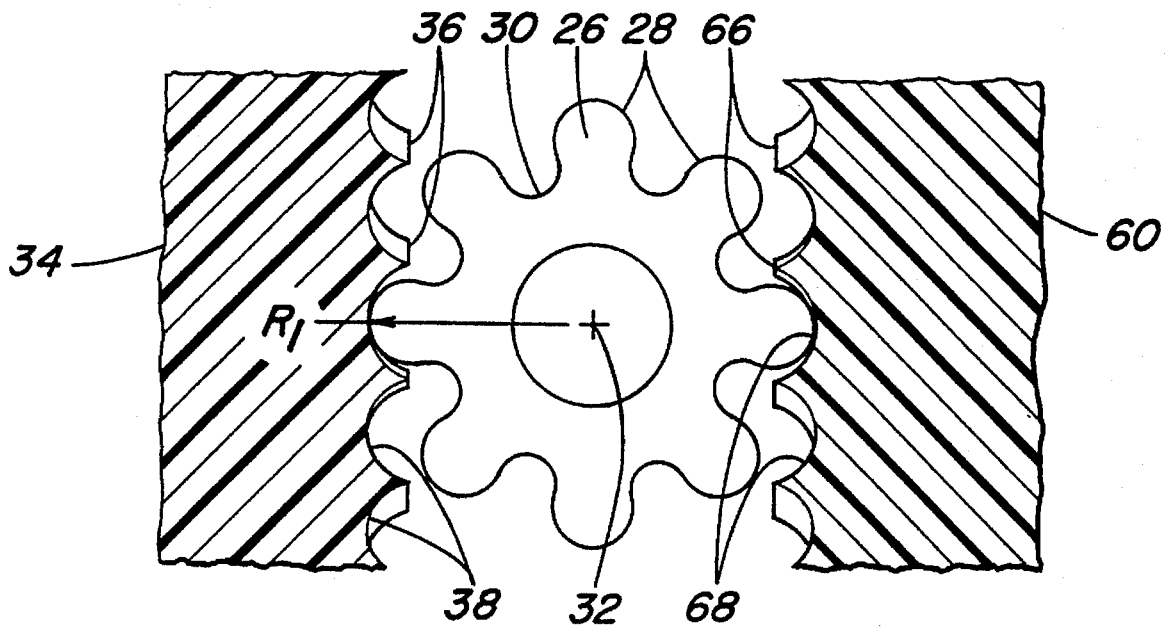
Fig. 5A

ROLLING DETENT MECHANISM

BACKGROUND OF THE INVENTION

The subject invention is directed toward the art of indexing or detent mechanisms and, more particularly, to a rolling planetary detent device.

The invention is especially suitable for use in controlling the setting of a temperature control device and will be described with reference thereto; however, the invention is capable of broader application and could be used in a variety of other system.

Temperature controls that do not have detent mechanisms and defined set positions do not provide the operator with tactile feel during adjustment. Thus, the operator does not receive feedback on the amount the control has moved nor how much temperature change is expected. Also, such controls are less able to maintain set positions and can move due to vibrations.

Although various types of detent mechanisms have been used in temperature control systems, they have often been somewhat unsatisfactory. For example, noise, a non-uniform feel, erratic force requirements have been problems.

SUMMARY OF THE INVENTION

The subject invention provides a detent mechanism that is suitable for use in temperature control systems and which has a smooth, uniform feel and generates a minimum of noise. In accordance with the subject invention, there is provided a detent mechanism that includes a first wheel member mounted for rotation about a first axis and having a plurality of lobes circumferentially spaced about the first axis and extending radially outward relative thereto. A second wheel of circular configuration has outwardly extending ribs spaced for driving engagement with the first wheel. The ribs of the second wheel are related to the lobes of the first wheel such that driving rotation between the first wheel and the second wheel requires relative movement of the wheels away from one another in a direction perpendicular to the first axis. A drive member is provided for selectively rotating one of the first and second wheels and a spring assembly acts to bias the first and second wheels toward one another in a direction perpendicular to the first axis.

The design and relationship of the ribs and the lobes is such that the distance between the axis of the first wheel and the effective pitch line of the ribbed wheel undergoes alternate increase and decrease as driving engagement takes place between the two wheels. By maintaining a bias tending to force the wheels toward one another, the force required to drive the wheel in rotation increases and decreases in a distinct stepwise or intermittent manner. The lobed configuration of the first wheel, however, and the relationship with the ribs provides a relatively smooth input movement having a distinct step type feel and operation.

In one form, and in accordance with a preferred embodiment of the invention, the second wheel is mounted for rotation about an axis perpendicular to the first axis and a third wheel is mounted in alignment with the second wheel and is provided with outwardly extending ribs engaged with the lobes of the first wheel in the same manner as the second wheel. The lobe wheel is thus captured between the second and third wheels and the spring assembly acts to bias the second and third wheels toward one another which also acts to bias the first and second wheels toward one another.

It has been found desirable to preferably utilize a plurality of the first lobed wheels mounted to simultaneously engage at uniformly spaced positions about the second wheel. This results in a somewhat smoother operation and provides a safety feature in case of failure of one of the lobed wheels.

In its preferred form, the drive member is a shaft mounted for rotation coaxially with the axis of the second wheel. At least one of the first and second wheels are directly driven by the shaft.

As can be seen from the foregoing, a primary object of the invention is the provision of a simple and highly effective detent mechanism that can be used to produce a distinct step-by-step movement of a rotary shaft.

A further object of the invention is the provision of a mechanism of the type described that is comparatively simple to construct and which can be formed from injection molded plastic components.

Yet another object of the invention is the provision of a detent mechanism which is specially smooth acting and relatively quiet and can be formed in a compact design.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 3 is a cross-sectional view taken on line 3—3 of FIG. 2;

FIG. 4 is an isometric exploded view showing the major internal components of the FIG. 2 mechanism; and, FIGS. 5 and 5A are partial cross-sectional views taken on line 5—5 of FIG. 3.

DETAILED DESCRIPTION OF THE PREFERRED EMBODIMENT

Figure 1:
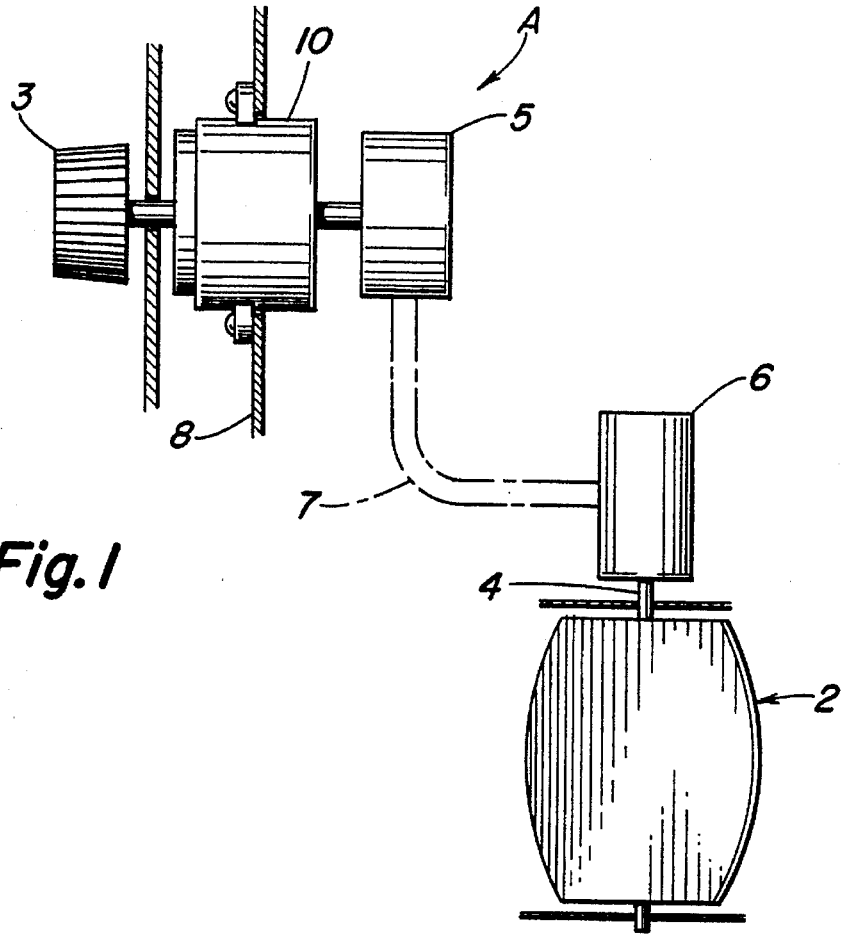
FIG. 1 is a somewhat diagrammatic showing of a vehicle temperature control system incorporating a detent mechanism formed in accordance with the subject invention.

Referring now to the drawings wherein the showings are for the purpose of illustrating the preferred embodiment of the invention only and not for purpose of limiting same, FIG. 1 is a somewhat diagrammatic showing of a vehicle temperature control system A which includes a blend door or damper 2 that functions to control the relative quantities of conditioned air and unconditioned and/or recirculated air to achieve a desired temperature of input air to the passenger compartment. The blend door 2 is adjusted from a manually operated control knob 3 connected in driving relationship with the blend door support shaft 4 through gear drive assemblies 5 and 6, and a flexible drive 7.

In order to provide feedback to the operator and to provide a sense of the relative amount of adjustment that has taken place through turning of the control knob 3, a detent mechanism 10 is positioned in directly driven relationship between knob 3 and gear drive assembly 5.

Figure 2:
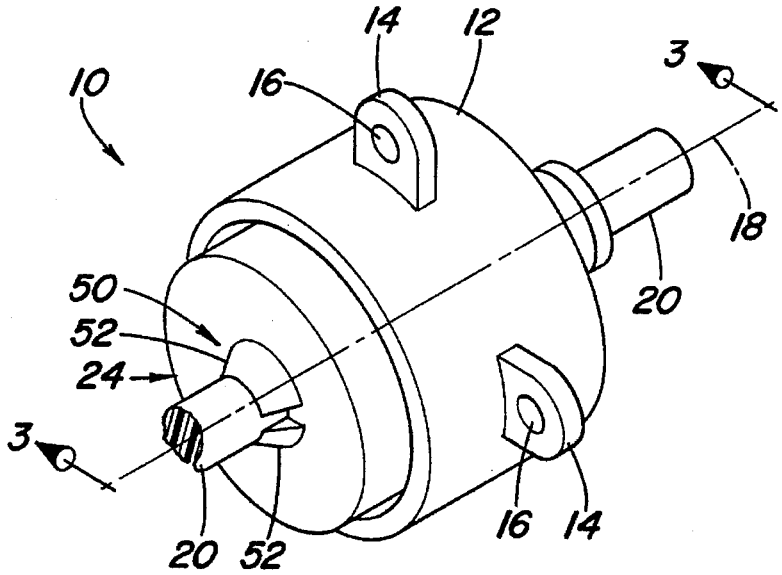
FIG. 2 is an isometric view showing the overall arrangement of a detent mechanism formed in accordance with the subject invention.

FIG. 2 is an isometric showing of the preferred form of detent mechanism 10 which generally comprises a somewhat cylindrical, cup-shaped main housing 12 provided with means for suitably mounting the housing in a stationary position to associated structure, such as frame component 8 in FIG. 1. In the subject embodiment, the mounting means are shown as outwardly extending tabs or ears 14. The tabs 14 are provided with mounting holes 16 for the receipt of suitable fasteners or the like.

Rotatably supported in the housing 12 for rotation about the longitudinal axis 18 is a generally cylindrical shaft 20. Operatively connected with the shaft 20 and mounted within the housing 12 is a detent assembly 24. The assembly 24 will subsequently be described in great detail, but for the present, it should be noted that it is intended to provide a distinct step-by-step movement to rotation of the shaft 20. It should, of course, be understood that movement of the shaft 20 could be through the use of a simple manual knob. Alternatively, it could be connected to other drive mechanisms associated with either end of the shaft 20.

The mechanism 10 can be incorporated in many different structures but is preferably designed for use in a temperature control system with a manual input knob. The mechanism then provides a step-by-step feel and distinct feedback to the operator in the setting of the associated temperature control mechanism.

Before dealing and describing the specific preferred structure of the assembly 24, attention is directed to FIGS. 5 and 5A which best illustrate the detent concept involved in the assembly 24. In particular, as shown in FIG. 5, the assembly makes use of one or more first wheels 26 that are provided with radially extending lobes 28 uniformly spaced circumferentially about the outer periphery of the wheel 26. The lobes could have different configurations but are shown as each being of identical configuration with a generally circular shape spaced by semi-circular root portions 30. The wheel 26 is mounted for rotation about a center axis 32.

As best seen in FIG. 5, the lobes preferably are uniformly spaced and arranged to engage with an associated second wheel 34 having an array of ribs 36 separated by an array of uniformly spaced semi-cylindrical recesses 38. The recesses 38 form the root areas between the individual ribs 36. The distance between the recesses and ribs must be selected with reference to the size and spacing of the lobes to mate with and provide driving engagement with the lobes 28 of the wheel 26. The semi-cylindrical shape of the recesses 30 and the generally cylindrical shape of the lobes 28 provides smooth driving engagement between the wheel 26 and the wheel 34.

In the preferred embodiment, the wheel 34 is mounted with its axis of rotation perpendicular to the axis of rotation 32 of the wheel 26. This particular relationship will become more apparent with respect to the detailed discussion to be set forth in conjunction with FIGS. 3 and 4. Referring again to FIG. 5, it will be seen that the radius $R_1$, which is the distance from the center axis 32 to the maximum radial extent of the lobes 28, is greater than the radius $R_2$, which is the distance from the axis 32 to a line that is tangent to two adjacent lobes 28. When adjacent lobes are in a rest position straddling a rib 36, rotational driving movement to the position of FIG. 5A requires that the wheel axis 26 be moved away from the wheel 34 by an amount equal to the difference between $R_1$ and $R_2$. During the subsequent rotary motion of the wheel 26, the distance returns to the $R_2$ distance shown in FIG. 5. Thus, as wheel 26 rotates relative to wheel 34, the distance between the axis 32 and wheel 34 must constantly change. If a bias is maintained on one or both of the wheels 26, 34 tending to force them toward one another, then the force required to rotate the wheels in driving engagement constantly varies at a uniform rate producing a stepwise feel to the motion and a constantly varying force requirement. The wheel 26, of course, constantly goes from the unstable position of FIG. 5A wherein the biasing force acts to move it to the FIG. 4 stable or straddled position. The forces and the number of steps per 360° rotation of the wheel 26 or wheel 34 can be varied by varying the nature and/or number of lobes on wheel 26, or the nature and/or number of ribs and recesses on wheel 34. By varying the various parameters, a variety of different motions of an indexed nature can readily be achieved.

The concepts of the invention as described with reference to FIGS. 5 and 5A could be embodied in many different structures. However, the preferred form is shown in FIGS. 3 and 4. In particular, as illustrated, the preferred form uses an arrangement wherein four of the lobed wheels 26 of identical size and configuration are carried on a disk-like carrier assembly 40. The wheels 26 are mounted for rotation about separate axes 32*a*, 32*b*, 32*c*, and 32*d* which lie in a single plane and are each spaced from the adjacent axis by 90°. The preferred form of the wheel members 26 and the carrier 40 are best seen in FIG. 4.

Preferably, the components are formed as injection molded plastic elements with each of the wheels 26 including an axle portion 42 resiliently clamped in the associated arcuate elements 44 and 46 (FIG. 3) formed to extend outwardly from the carrier 40. The carrier 40 and the inner ends of the axles 42 define a central opening 49 which is sized so as to closely but rotatably receive the center portion 20*a* of shaft 20. This can best be seen in FIG. 2.

The previously-mentioned wheel 34 is illustrated in FIGS. 4 and 5 and has a generally cup-shaped configuration with the ribs 36 and recesses 38 positioned on the upper edge of the continuous side wall 48. The ribs thus are laid out to extend radially of the axis of rotation be of shaft 20 for engagement with the lobes of the four wheels 26. As seen in FIG. 3, the wheel 34 is drivingly connected with shaft 20 at its center hub 50. In this embodiment, a positive interengagement is achieved between shaft 20 and hub 50 by cooperating resilient tabs 52 and recesses 54 on the hub 50 and shaft 20, respectively.

The preferred form of detent assembly 24 further includes a third wheel member 60 comprised of a center disk portion 62 and a circumferential, axially-extending flange section 64. The upper edge of the side wall portion 64 is provided with corresponding ribs and recesses 66 and 68, respectively (see FIGS. 5 and 5A). The spacing and shape of the ribs and recesses 66 and 68 correspond to the previously discussed ribs and recesses 36, 38 of the wheel 34. In the subject embodiment, the wheel 60 is carried on an internal hub portion 70 formed within the housing 12 and coaxially located about the axis 18.

As best seen in FIG. 4, the disk 62 of wheel 60 includes a smooth center opening 72 provided with a key way 74. A corresponding key portion (not shown) on hub 70 prevents rotation of wheel 60 relative to hub 70 while permitting free axial sliding movement in directions parallel to axis 18. As shown in FIGS. 3, 5, 5nd 4A, the wheel 60 can thus be moved into engagement with the lobed wheels 26. A biasing force is applied to the wheel 60 so as to, in turn, bias the lobed wheels 26 toward the wheel 34 so that rotation of the shaft 20 results in the previously discussed indexing movement. In the subject embodiment, the biasing of wheel 60 toward the lobed wheels 26 and the wheel 48 is accomplished through the use of a two compression springs S0 spaced diametrically and radially outward of the axis be. The compression springs 80 are carried in suitable chambers or recesses 82 molded in the housing 12 and opening toward the wheel 60. By varying the compression forces of springs 80, the force required to rotate shaft 20 can be varied. The resulting feel of the indexing movement is also thus varied.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A rotary detent mechanism comprising:

a first wheel mounted for rotation on a first axis and having a plurality of radially outwardly extending lobes uniformly spaced circumferentially thereabout;

a second wheel mounted for rotation about a second axis and having a plurality of ribs located at spaced locations circumferentially thereof in driving engagement with the lobes of the first wheel, the lobes and the ribs being shaped and related such that driving rotation between the first wheel and the second wheel requires relative reciprocating shifting movement of the first wheel and the second wheel toward and away from one another in directions perpendicular to the first axis; and, spring means for biasing the first and second wheels toward one another in directions perpendicular to the first axis.

2. A detent mechanism comprising:

a) a first wheel member mounted for driven rotation about a first axis, said first wheel member having spaced ribs extending radially of the first axis;

b) a second wheel member mounted coaxially with the first wheel member in spaced, non-rotational relationship thereto and having radially extending ribs in face-to-face alignment with the spaced ribs on the first wheel member;

c) at least one lobed wheel positioned in engagement between the ribs of the first and second wheel members, said lobed wheel mounted radially outwardly of the first axis for rotation on a second axis that angularly intersects the first axis;

d) the first and second wheel members mounted for movement toward and away from one another along said first axis and means for biasing at least one of the first and second wheel members axially toward the other of the first and second wheel members; and, e) said at least one lobed wheel is sized and related to the ribs of the first and second wheel members so that said lobed wheel can rotate about the second axis and relative to the first and second wheel members only by producing movement of the at least one of the first and second wheel members away from the other of the first and second wheel members against the bias of said means for biasing.

3. The detent mechanism as defined in claim 2 wherein there are a plurality of said lobed wheels mounted in circumferentially spaced locations about the first axis.

4. The detent mechanism as defined in claim 2 wherein the ribs of the first and second wheel members are carried on surfaces lying in planes perpendicular to the first axis.

5. The detent mechanism as defined in claim 2 wherein said first wheel member is non-rotatably mounted on a manually rotatable shaft that defines the first axis.

6. A detent mechanism comprising:

a first wheel mounted for rotation about a first axis, said wheel having a plurality of lobes circumferentially spaced about said axis and extending radially thereof;

a second wheel of circular configuration having outwardly extending ribs spaced for driving engagement with the first wheel and mounted for reciprocating movement toward and away from the first wheel, said ribs being sized and related to said lobes such that driving rotation between the first wheel and the second wheel requires relative reciprocating movement of the wheels toward and away from one another in a direction perpendicular to the first axis;

a drive member for selectively rotating one of the first and second wheels; and, a spring assembly for biasing the first and second wheels toward one another in a direction perpendicular to the first axis.

7. The detent mechanism as set forth in claim 6 wherein said second wheel is mounted for rotation about a second axis perpendicular to the first axis.

8. The detent mechanism as set forth in claim 7 including a third wheel mounted in axial alignment with the second wheel, said third wheel provided with outwardly extending ribs engaged with the lobes of the first wheel.

9. The detent mechanism as defined in claim 8 wherein the drive member includes a cylindrical shaft mounted for rotation about its longitudinal axis and drivingly connected to the third wheel.

10. The detent mechanism as defined in claim 9 wherein the second and third wheels are coaxial with the shaft.

11. The detent mechanism as defined in claim 10 wherein the first axis is perpendicular to the longitudinal axis of the shaft.

12. The detent mechanism as defined in claim 10 wherein the first wheel is carried on a support member mounted for rotation about the shaft.

13. A detent mechanism comprising:

a first wheel mounted for rotation about a first axis, said wheel having a plurality of lobes circumferentially spaced about said axis and extending radially thereof;

a second wheel mounted for rotation about an axis perpendicular to the first axis, said second wheel being of circular configuration and having outwardly extending ribs spaced for driving engagement with the first wheel, said ribs being related to said lobes such that driving rotation between the first wheel and the second wheel requires relative movement of the wheels toward and away from one another in a direction perpendicular to the first axis;

a drive member for selectively rotating one of the first and second wheels;

a spring assembly for biasing the first and second wheels toward one another in a direction perpendicular to the first axis; and, a third wheel mounted in axial alignment with the second wheel for movement axially toward and away from the second wheel, said third wheel provided with outwardly extending ribs engaged with the lobes of the first wheel.

14. The detent mechanism as defined in claim 13 wherein the spring assembly acts to bias the third wheel and the second wheel toward the first wheel.

* * * * *